United States Patent [19]

Liguori

[11] Patent Number: 4,502,381

[45] Date of Patent: Mar. 5, 1985

[54] ROTATIONAL REGISTER SYSTEM

[75] Inventor: Thomas Liguori, San Diego, Calif.

[73] Assignee: National Pen Corporation, San Diego, Calif.

[21] Appl. No.: 497,662

[22] Filed: May 24, 1983

Related U.S. Application Data

[63] Continuation-in-part of Ser. No. 214,176, Dec. 8, 1980, abandoned.

[51] Int. Cl.[3] ..... B41F 17/22

[52] U.S. Cl. ..... 101/40; 101/7; 101/25; 198/377

[58] Field of Search ..... 101/38 R, 38 A, 39, 101/40, 7, 8, 9, 11, 21, 25, 27, DIG. 16, 407 A, 126; 29/281.1; 72/398; 279/9 R, 76, 105; 269/48, 49, 50, 51, 52; 227/148; 198/377

[56] References Cited

U.S. PATENT DOCUMENTS

| | | | |
|---|---|---|---|
| 2,132,818 | 10/1938 | Cone | 101/40 X |
| 2,924,169 | 2/1960 | Scott | 101/40 |
| 2,987,727 | 6/1961 | Gibbons et al. | 227/130 X |
| 3,110,247 | 11/1963 | Simpson | 101/38 R |
| 3,250,213 | 5/1966 | Brigham et al. | 101/40 |
| 3,568,817 | 3/1971 | Douglas et al. | 198/377 |

*Primary Examiner*—Edgar S. Burr
*Assistant Examiner*—Charles A. Pearson
*Attorney, Agent, or Firm*—Spensley Horn Jubas & Lubitz

[57] ABSTRACT

A rotational register system comprising a mandrel and a roll transfer design mechanism, with a female keyway disposed on one end of the mandrel and configured to engage a male keyway on the inner surface of a pen cap to rotationally register said pen cap relative to the starting and ending point of the transfer mechanism is disclosed. There is further provided a clip attaching mechanism with a second mandrel also having a female keyway such that the seam of a design on the pen cap will be directly covered by the clip.

11 Claims, 8 Drawing Figures

Fig. 2
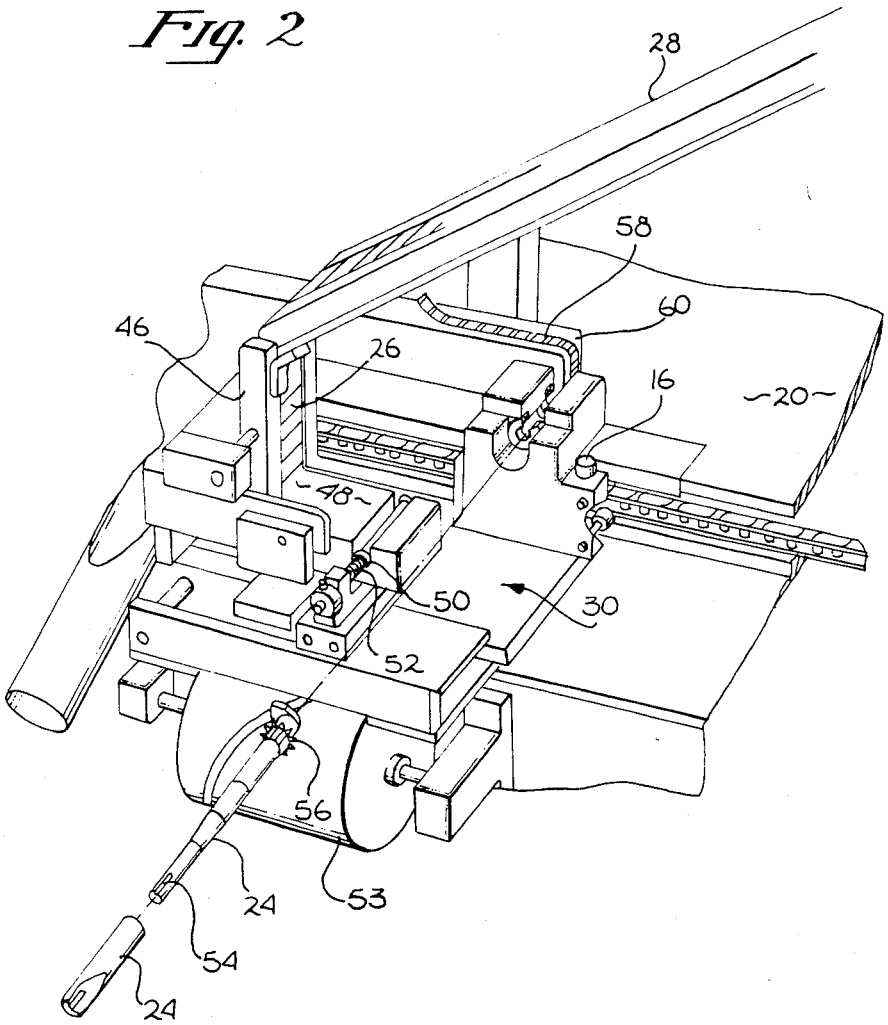
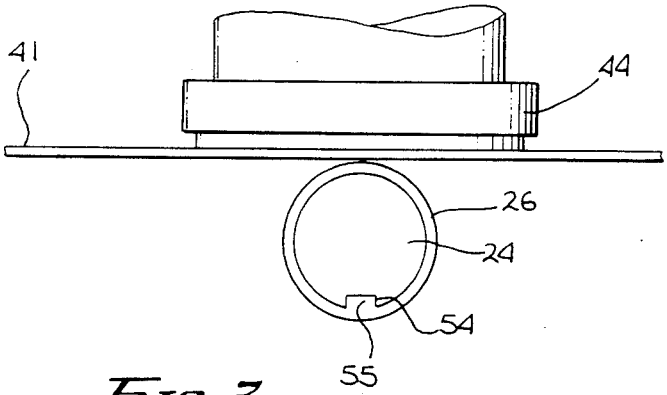
Fig. 3

ROTATIONAL REGISTER SYSTEM

BACKGROUND OF THE INVENTION

1. Prior Applications

This application is a continuation-in-part of application Ser. No. 214,176, filed Dec. 8, 1980, now abandoned.

2. Field of the Invention

This invention relates to mechanisms for affixing multi-color designs and clips to cylindrical objects such as pen caps and lipstick cases, and more particularly, to an improved design of the mandrel and associated driving mechanism.

3. Prior Art

There are many ways for decorating pen caps and other cylindrical objects in the trade today. One method currently used is known as the heat transfer method. Pursuant to this method, a mylar film is used which has printed on it decorations or images. The film is produced in large rolls. The mylar film is trapped between the product and a heat pad, and the image is roll-transferred onto the product. The heat and pressure releases the design from the film to the product as the product rotates. However, 360 degrees from the point that the image starts to transfer to where it completes the transfer, there will be a seam. A seam, also known as an overlay, in many ways takes away from the finished look of the image at the area of the overlay. In addition, especially where multiple roll transfers are applied on any one product, there is a need to improve the finished look, such that all of the overlays occur in the same area.

In the manufacture of pen caps, a pocket clip is usually designed for carrying purposes. For asthetics, it is common to position the clip over the area of the overlay on caps decorated as described above, and thus hide the seam somewhat. In those instances where there is no seam, the clip should be positioned so as not to overlay the design.

The conventional method for affixing the clip to the cap so decorated is to manually enter the cap onto a mandrel and align it by eye to the proper position so that the clip will cover the seam(s). This is a slow and inaccurate method for performing this operation. It is therefore desireable to provide a means for aligning the seam on the pen cap with the clip. There are a number of devices known in the art designed to secure and align articles while certain operations such as designing or molding are being operated on them. These are discussed in related application Ser. No. 214,176, which is incorporated herein by reference.

The previous application Ser. No. 214,176 illustrated one method which overcame some of the problems associated with the prior art by providing an "in-line" system which had certain distinct advantages in connection with the application of roll transfers to cylindrical objects. The present invention is directed to yet a further improved system.

SUMMARY OF THE INVENTION

Broadly, the present invention is directed to a machine or rotational register system used to position multiple decorations or advertising materials on cylindrical objects such as pen caps and lipstick cases such that the decorations are applied in a controlled manner without the creation of undesired overlays.

The rotational register system of the present invention comprises a continuous belt and associated driving mechanism to which a plurality of generally cylindrical mandrels are joined. Each of the mandrels has a first alignment means for selectively engaging and aligning an object to be printed, and a second alignment means for axially aligning and rotating the mandrel. At least one print station, and preferably two or three, are located adjacent the belt each for transferring a design or a color from a film to the object to be printed. There is also means located adjacent to each print station for engaging the second alignment means on the mandrel and rotating the mandrel in a predetermined path. In this manner, even multiple color designs can be accurately printed on the object such that the overlay(s) are all substantially in alignment.

The mandrel has a diameter slightly smaller than the inner diameter of the cylindrical object, such as the pen cap, desired to be decorated such that the object fits snugly over the mandrel. There is a male keyway molded into the inner surface of the object adjacent a closed end thereof. The male keyway is configured to selectively engage the first alignment means, a female keyway disposed on the mandrel, such that when the object is pushed onto the mandrel and turned so that the two keyways are aligned, the male key on the object will be inserted into the female keyway on the mandrel. In this manner the object is prevented from rotating about the mandrel. By the use of these keyways, axial rotation of the cylindrical object can be accurately controlled. In turn, accurate application of even multiple colors can be achieved. This is of significant importance as the application of separate colors, as opposed to one decal, enables the system of the present invention to make multi-color overlays at substantial cost savings.

Another advantage associated with the present invention is that the mandrel is free to axially rotate until the printing or roll-transferring process begins. This places much less torque on the rotating chain.

Prior to printing, the mandrel passes through an index plate which properly aligns the mandrel, and thus the cylindrical object to be printed. The mandrel is then engaged by a track such that the point where printing begins is always the same. That is, even though multiple mandrels may travel through multiple print stations, each print will begin at the same location on each mandrel. This enables yet further accuracy of the printing process. In this manner, intricate and multicolor designs can be quickly transferred to the cylindrical object without the unsightly overlays associated with the prior art.

For decals, there is a large roll of mylar film which has decorations or images printed on it. The mylar film is trapped between the object on the mandrel and a heat pad. The mandrel, previously rotated into the desired position, is then rotated laterally under the mylar film. The heat from the heat pad causes a design on the mylar film to be transfered to the object as it rotates. After printing, the object can then be removed and the process repeated.

For color printing, multiple color stations are used, each station transferring a desired color to the object, as describe above. Upon completion, the object is then removed and the process repeated.

There is also provided a mechanism for affixing a clip to the cylindrical object if such is desired. In such mechanism another mandrel is provided with a female keyway similar to the design of the mandrel used with the heat transfer machine. When the object is removed from the mandrel of the heat transfer machine, it is then transferred to the mandrel on the clip attaching device and rotated until the male keyway on the object selectively engages the female keyway of the second mandrel. The clip to be attached to the object is disposed in a nest within a die with its prongs for engaging the object extending upwardly. The mandrel with the object disposed thereon is positioned over the clip and pressed downward onto it such that the prongs on the clip are pushed through the surface of the object thus securing the clip thereto. The female keyway on the second mandrel is aligned such that when the male keyway on the object is properly engaged therewith, the seam or overlay of the design on the object will be positioned directly under the clip. In this manner the clip will cover the seam when it is affixed to the object. Thus, the seam is automatically positioned underneath the clip without the necessity of human intervention in the alignment process. This alignment can therefore be accomplished much faster than with prior art mechanisms, as well as more accurately.

The novel features which are believed to be characteristic of the invention, both as to its organization and method of operation, together with further objectives and advantages thereof, will be better understood from the following description considered in connection with the accompanying drawings in which a presently prefered embodiment of the invention is illustrated by way of example. It is to be expressly understood, however, that the drawings are for the purpose of illustration and description only, and are not intended as a definition of the limits of the invention.

BRIEF DESCRIPTION OF THE DRAWINGS

FIG. 2 is an enlarged perspective view showing the mounting and dismounting system used in the present invention.

FIG. 3 shows a plan view of the roll transfer in operation.

DETAILED DESCRIPTION OF THE INVENTION

Figure 1:
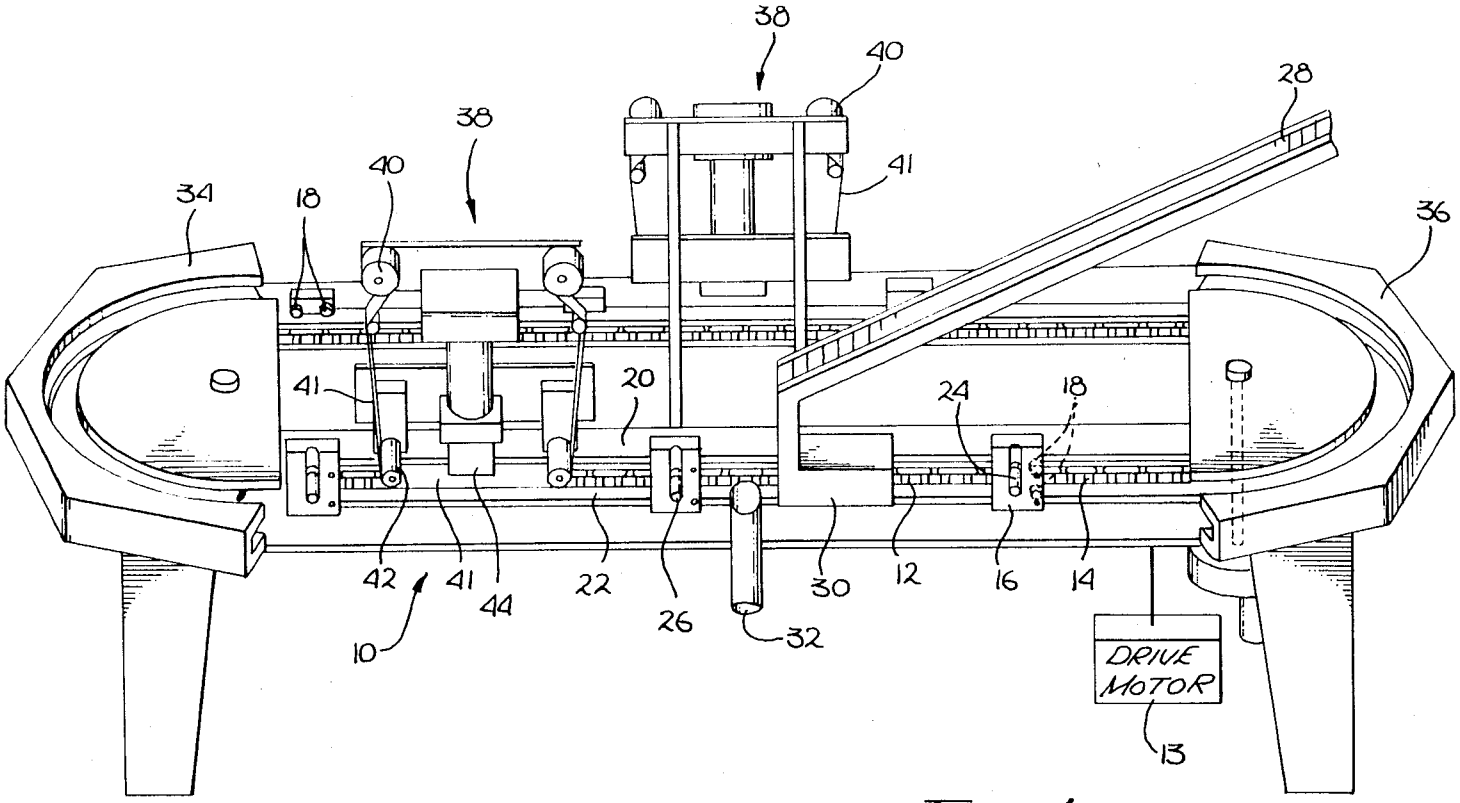
FIG. 1 is a perspective view showing the rotational register system of the present invention.

Referring first to FIG. 1, one can see the rotational register system of the present invention. As illustrated, the system includes an oval raceway 10 having an endless track or belt 12 and associated driving means 13 such as a motor. Track or belt 12 is generally comprised of a series of interconnected metal chain links 14 such as are well known in the art. Joined to the endless belt 12 and extending outwardly therefrom are a series of movable mounting members 16, each having a generally rectangular configuration. Mounting members 16 include a plurality of bearing wheels 18 which enable mounting member 16 to easily glide around the raceway 10. In the preferred embodiment, such bearing wheels 18 engage top and bottom guides 20, 22, of the raceway 10. Extending outwardly from each of the movable mounting members 16 and generally parallel to the raceway 10 is a generally cylindrical mandrel 24. Each such mandrel 24 is arranged and configured so as to enable a generally cylindrical, tubular object such as a pen cap 26 to be readily joined thereto.

As shown in FIG. 1, a feed slot generally indicated at 28 enables the pen caps 26 to slide down towards loading mechanism 30. There is also included a chute 32 for discharging the pen caps 26 after they have been printed as hereinbelow described.

First and second heater means 34, 36 are provided at each end of the raceway 10 and are used to maintain the pen caps 26 at a temperature somewhat elevated from ambient. In the preferred embodiment, the register system includes a plurality, usually 3 or 4, of print stations 38 which can apply different designs and/or colors to the pen caps 26. Each of the print stations 38 includes a roll 40 of film 41. The film 41 is disposed across associated rollers 42 beneath a heated pad or platen 44. As pen caps 26 move beneath each of the print stations 38, they engage film 41 and are imprinted with a particular color and/or design.

Referring now to FIGS. 2 and 3, one can see that the loading mechanism 30 includes a feed guide 46 which feeds the pen caps 26 into a groove 50 formed in a laterally movable plate 48. Plate 48 initially moves in the opposite direction of movement of belt 12 to a position under feed guide 46 where a pen cap 26 is received in groove 50. Timing is controlled such that a mandrel 24 is in position to receive cap 26. Plate 48 is then moved in unison with the movement of mandrel 24. As plate 48 and mandrel 24 move in unison, the pen cap 26 is urged toward the mandrel 24 by a spring loaded insertion rod 52. The movement of rod 52 is controlled by a cam mechanism (not shown). Rod 52 urges pen cap 26 towards the mandrel 24 until a female keyway 54 on the mandrel 24 is engaged with and joined to an outwardly extending protrusion or male keyway 55 formed on the inside surface of pen cap 26. This is achieved by placing a friction pad at the end of rod 52 which prevents cap 26 from rotating until the keyways are aligned. The rod 52 is then withdrawn. This procedure is repeated by moving plate 48 back towards feed guide 46 where another cap is loaded into groove 50. This back-and-forth movement is regulated by cam means 53. Other means for moving plate 48 are also within the scope of this invention.

Again referring to FIGS. 2 and 3, one can see that mandrel 24 has first and second ends with keyway 54 being located adjacent the first end thereof and a series of outwardly extending protrusions or sprocket gears 56 disposed adjacent the second end thereof. Protrusions 56 engage a track 58, or other engagement means, mounted on bracket 60 which causes mandrel 24 to axially rotate as the mandrel 24 moves around the raceway 10. Selective engagement of protrusions 56 into track 58 enables accurate control of the axial rotation of the mandrel 24. This axial rotation is controlled and regulated during the printing operation as well as during the initial mounting of cap 26 on mandrel 24.

In the preferred embodiment, mandrel 24 has a diameter slightly less than the inner diameter of the tubular object onto which one desires the design to be transferred. As stated above, pen cap 26 is envisioned as the tubular object, but other objects such as lipstick cases and the like may also be used. Pen cap 26 is cylindrical, usually has one open end and one closed end, and is configured to slip snugly over the mandrel 24.

Figure 4:
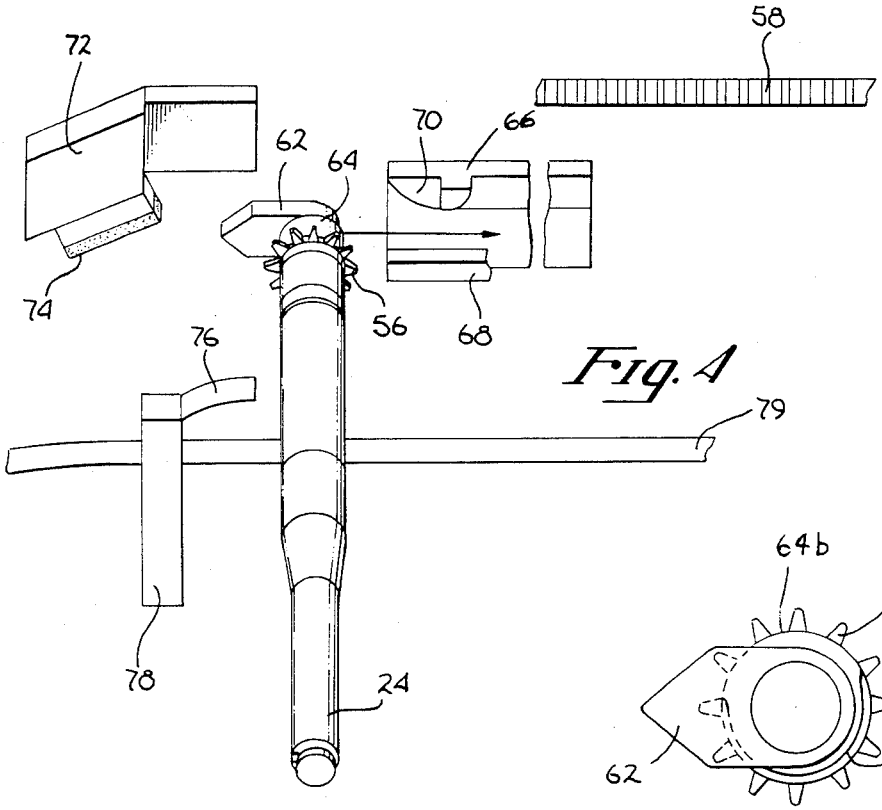
FIG. 4 is an enlarged perspective view showing the mandrel and alignment system of the present invention.
Figure 5:
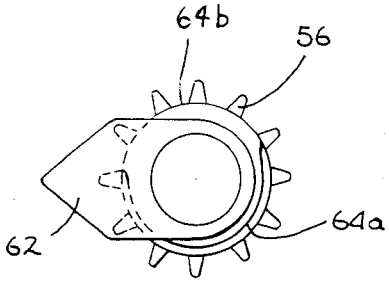
FIG. 5 is an end view of the mandrel of the present invention.

Referring now to FIGS. 4 and 5, more detailed view of some of the elements of each print station 38 are illustrated. In FIGS. 4 and 5, one can see that mandrel 24 includes a pointed index member 62 adjacent protrusions 56. Mandrel 24 also has a cam 64 which is configured so as to enable mandrel 24 to be axially rotated into a predetermined position. An index plate 66 having a first guide rail 68 and second guide rail 70 is configured such that after index member 62 has been properly aligned, such alignment is maintained i.e. index member 62 is pointing away from the direction of travel as it moves between guide rails 68 and 70. To insure the proper position of index member 62, an inclined friction member 72 having a strip of friction material 74 is positioned along the path of travel prior to the index plate 66. Friction member 72 selectively engages cam 64 and rotates the mandrel 24 so that index member 62 is pointing generally in the direction as illustrated in FIG. 4. Then, further controlled alignment is achieved as the index member 62 passes between the first and second guides 68, 70. A spring clip 76 disposed on post 78 is located adjacent each print station 38 and is used to help insure a proper position of cap 26 on the mandrel 24 prior to printing. More specifically, clip 76 is configured to urge pen cap 26 onto the mandrel 24 should the same become loose during rotation around the race track 10.

Figure 4A:
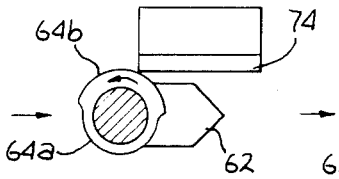
FIGS. 4A and 4B illustrate how the mandrel is selectively rotated.
Figure 4B:
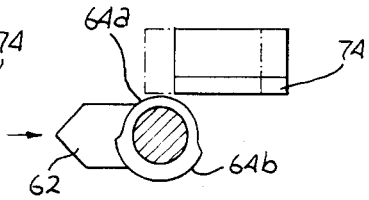

Referring now to FIGS. 4A and 4B, one can see that if index member 62 is improperly aligned (FIG. 4A) friction member 74 engages the high dimension **64*b* of cam 64 and rotates the mandrel 24 so that the index member 62 is now as illustrated in FIG. 4. Should the index member 62 be positioned as shown in FIG. 4B, cam 64 will not engage friction member 74 as the low demension 64*a* is selected so as to clear the friction member 74**.

OPERATION

Referring now to FIGS. 1 and 3, after the pen cap 26 has been mounted on mandrel 24 by loading mechanism 30, mandrel 24 is initially free to axially rotate as it proceeds around the race track 10. This freedom of movement prevents undue hangups of the belt 12 and the need to make belt 12 withstand very high tensions and torques. Ease of travel is also encouraged by means of bearing wheels 18. Belt 12 carries mandrel 24 and associated cap 26 to a first print station 38. As discussed above, one of the problems associated with the prior art was the inability to accurately and quickly print a cylindrical object. This can be especially exaserbated when multiple printings are to be done.

In the present invention, alignment problems are substantially solved by the use of a plurality of alignment means, and a uniquely designed mandrel 24. The first alignment means comprises the female keyway 54 formed on mandrel 24 which engages the male keyway 55 located adjacent the closed end of cap 26. By this arrangement, the cap 26 is axially held in a desired position on mandrel 24.

The second alignment means comprises protrusions 56 located on the opposite end of mandrel 24 from the keyway 54. Protrusions 56 engage track 58 thus causing mandrel 24 to axially rotate. Because the same protrusion is always engaged by track 58, proper alignment of the mandrel 24 is also achieved. The third alignment means comprises the cam 64 and off-center index member 62, both mounted on mandrel 24 adjacent protrusions 56. By the use of the female keyway 54, protrusions 56 and index member 62 and cam 64, all mounted on mandrel 24, a straight forward and effective solution to the problem of positioning the mandrel 24 is achieved. In addition, a cost effective, yet highly accurate method is provided which can create multi-color designs on cylindrical objects.

As mandrel 24 approaches each print station 38, if the index member 62 is in the proper position (as previously described), lower portion **64*a* of cam 64 will be above the center line of the index member 62 (FIG. 4B). Proper entry into index plate 66 is thus achieved. Prior to engagement of track 58, index member 62 clears rail 68 so as to permit accurate and continuous turning of mandrel 24. By this method of alignment of mandrel 24, the same protrusion 56 is always engaged by track 58, thus extremely accurate printing on cap 26 can be achieved. In the event that low end 64*a* of cam 64 is positioned below the center line of the index member 62, prior to entering index plate 66, friction member 72 will contact the high dimension 64*b* of cam 64 (FIG. 4A) and will rotate mandrel 24 such that proper entry into index plate 66** is achieved.

As shown in FIGS. 3 and 4, after passing through index plate 66, the pen cap 26 is pressed against the transfer design of film 41. As the mandrel 24 rotates, the transfer design is caused to uniformly transfer to the pen cap 26 by the heat and pressure of platen 44. To insure good printing, mandrel 24 is urged toward the platen 44 by means of ramp 79 as shown in FIG. 4. Other similar means for urging the mandrel 24 toward platen 44 are also within the scope of the present invention.

After a minimum of 360 degrees of rotation of the mandrel 24, it is moved away from the film 41 by traveling down ramp 79 and the transfer process is stopped. If desired, a subsequent printing can be repeated at another location with different colors or designs.

Figure 6:
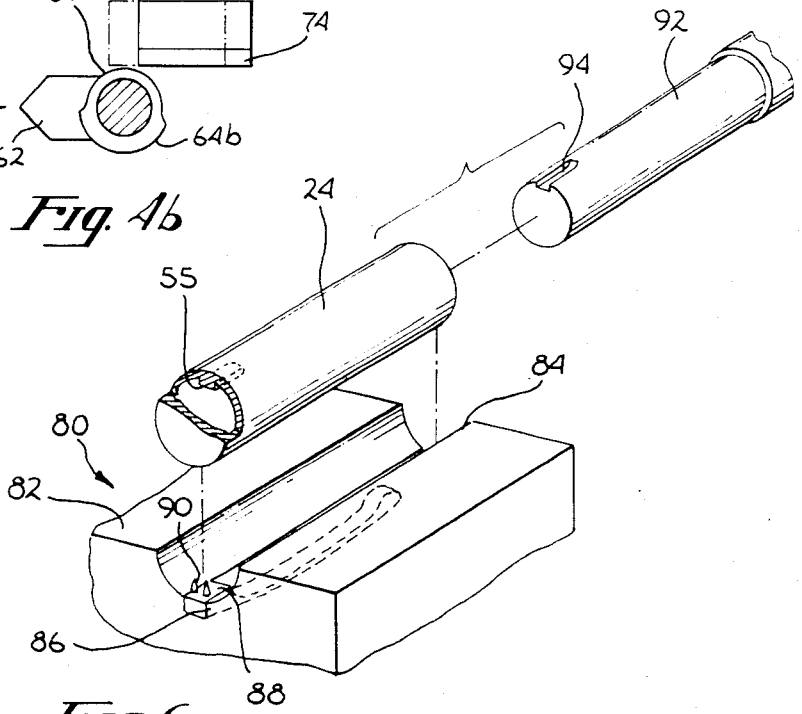
FIG. 6 is a perspective view showing the clip attaching mechanism of the present invention.

Even though the printing of tubular objects under the present invention is more accurate than many prior art methods, there may still be a slight area of overlap of the transfer design resulting in a seam. With pen caps especially, it is desired to hide the seam. This is done, as shown in FIG. 6, by placing a clip 88 for the pen cap 26 directly over the seam. With prior art devices, this alignment of the seam with the clip 88 had to be done by hand, and the alignment had to be registered by eye to the proper position so that the clip would cover the seam. The present invention provides for automatic alignment without the necessity of human intervention.

This is achieved by providing a clip attaching mechanism 80 which includes a die 82 have a semi-cylindrical cutout potion 84 of approximately the same diameter as cap 26. A nest 86 is formed in the bottom of cutout 84, and clip 88 is placed in nest 86. Prongs 90 of the clip 88 are placed upwardly toward the cap 26. A second mandrel 92 is attached to one end of a piston (not shown) and situated above and adjacent clip 88. Disposed on one end of the second mandrel 92, distal to the piston, is a female keyway 94 configured to selectively engage the male keyway 55 formed adjacent to closed end of the pen cap 26.

In operation, pen cap 26 is removed from the first mandrel 24 and disposed on the second mandrel 92. It is then rotated and pushed onto mandrel 92 until the male keyway 55 on the pen cap 26 engages the female keyway 94 on the second mandrel 92, thereby automatically axially aligning and securing the pen cap 26 in place. The female keyway 94 on the second mandrel 92 is aligned such that the design seam on the pen cap 26 is aligned directly adjacent the clip 88. The piston then moves towards the die 82 and thus causes the second mandrel 92 to push the pen cap 26 into the cutout 84 and onto the prongs 88 of the clip 82. The prongs 90 have sharp points such that they are pushed into the pen cap 26 thereby securing the clip 88 to the pen cap 26. Since the pen cap 26 has been automatically aligned with the clip 88 by means of the female keyway 94 on the second mandrel 92, clip 88 now directly covers the design seam on the pen cap 26.

By the use of the rotational register system of the present invention, not only is better alignment achieved as compared with prior devices, but the speed at which each pen cap can be printed is substantially improved.

Because a wide variety of materials, shapes, and other configurations can be used in this invention, it should be understood that changes can be made without departing from the spirit or scope of this invention. This invention, therefore, is not to be limited to the specific embodiments discussed and illustrated herein.

I claim:

1. In a rotational register system having a driving belt, a plurality of mandrels joined to said belt, engagement means for axially rotating said mandrels as said mandrels proceed around said driving belt and a plurality of print stations arranged such that an object to be printed disposed on each said mandrel is passed through each print station where it is printed, the improvement comprising:

each said mandrel having a first alignment means adjacent one end thereof for selectively engaging and rotationally aligning said object to be printed, a second alignment means disposed adjacent to the other end thereof for rotationally aligning and rotating said mandrel by interaction with said engagement means, and a third alignment means on said mandrel, for rotationally positioning said mandrel prior to said mandrel being rotated by said engagement means, said third alignment means comprising a pointed index member and a cam member, both mounted on said mandrel adjacent said second alignment means.

2. A rotational register system according to claim 1 when said second alignment means comprises a plurality of outwardly extending protrusions.

3. A rotational register system according to claim 1 further including means for selectively urging said object to be printed against said mandrel.

4. A rotational register system according to claim 1 further including an index plate, said third alignment means passing through said index plate thereby rotationally positioning said mandrel.

5. A rotational register system according to claim 1 further including heating means for heating said object to be printed.

6. A rotational register system according to claim 1, further including a substantially cylindrical, tubular object to be printed, said object having an interior surface with an alignment means disposed thereon for engaging said first alignment means on said mandrel.

7. A rotational register system according to claim 6, wherein said tubular object comprises a pen cap.

8. A rotational register system according to claim 1, including a clip attaching mechanism, said clip attaching mechanism comprising:

a second mandrel having an alignment means thereon; and means for holding a clip in a predetermined position.

9. A rotational register system according to claim 1, further including an inclined friction member for selectively engaging said third alignment means thereby moving said mandrel into a predetermined position.

10. A rotational register system according to claim 1, where said belt comprises a chain mounted in a substantially oval configuration lying in a horizontal plane.

11. In a rotational register system having a driving belt, a plurality of mandrels joined to said belt, engagement means for axially rotating said mandrels as said mandrels proceed around said driving belt, and a plurality of print stations arranged such that an object to be printed disposed on each said mandrel is passed through each print station where it is printed, the improvement comprising:

each said mandrel having a first alignment means adjacent one end thereof for selectively engaging and rotationally aligning said object to be printed, a second alignment means disposed adjacent to the other end thereof for rotationally aligning and rotating said mandrel by interaction with said engagement means, a third alignment means on said mandrel, for rotationally positioning said mandrel prior to said mandrel being rotated by said engagement means, said third alignment means including a cam and a pointed index member, and an inclined friction member for selectively engaging said cam thereby moving said mandrel to a predetermined position.

* * * * *